United States Patent [19]

Spuhler et al.

[11] Patent Number: 4,741,197

[45] Date of Patent: May 3, 1988

[54] EJECTION OF SUPERPLASTICALLY FORMED PART WITH MINIMUM DISTORTION

[75] Inventors: Edwin H. Spuhler, Colorado Springs, Colo.; James M. Story, Plum Boro, Pa.

[73] Assignee: Aluminum Company of America, Pittsburgh, Pa.

[21] Appl. No.: 856,023

[22] Filed: Apr. 25, 1986

[51] Int. Cl.[4] ..... B21D 45/02

[52] U.S. Cl. ..... 72/427; 72/344; 249/67; 249/74

[58] Field of Search ..... 72/38, 344, 345, 361, 72/427, 700, 60, 61, 347, 348, 63; 264/336; 425/436 R, 444; 249/67, 68, 74–76

[56] References Cited

U.S. PATENT DOCUMENTS

| | | | |
|---|---|---|---|
| 1,318,404 | 10/1919 | Penn | 249/67 |
| 1,690,523 | 11/1928 | Bell | 72/348 |
| 2,272,718 | 2/1942 | MacLagan et al. | 249/67 |
| 2,302,367 | 11/1942 | Ericson | 249/68 |
| 2,583,441 | 1/1952 | Palmer | 264/336 |
| 3,477,095 | 11/1969 | Lensky | 249/68 |
| 3,802,245 | 4/1974 | Garner et al. | 72/344 |
| 3,867,830 | 2/1975 | Dittwiler | 72/427 |
| 3,893,644 | 7/1975 | Drazick | 249/68 |
| 3,942,755 | 3/1976 | Robinson | 425/436 R |
| 4,354,369 | 10/1982 | Hamilton | 72/342 |
| 4,474,044 | 10/1984 | Leistner et al. | 72/700 |
| 4,502,309 | 3/1985 | Hamilton et al. | 72/342 |

FOREIGN PATENT DOCUMENTS

| | | | |
|---|---|---|---|
| 69077 | 5/1941 | Czechoslovakia | 72/344 |
| 1290304 | 3/1969 | Fed. Rep. of Germany | 425/444 |
| 3944 | 2/1969 | Japan | 72/427 |
| 37103 | 11/1971 | Japan | 425/444 |
| 188641 | 11/1983 | Japan | 425/444 |
| 110428 | 6/1984 | Japan | 72/427 |
| 131882 | 5/1951 | Sweden | 72/361 |
| 224996 | 8/1968 | U.S.S.R. | 72/427 |

*Primary Examiner*—Lowell A. Larson
*Attorney, Agent, or Firm*—Elroy Strickland

[57] ABSTRACT

A method of removing or ejecting a part from a first die after the part has been superplastically formed in a cavity of the die at an elevated temperature such that the part sticks to the surfaces of the die. The method includes the steps of forming a flange of the part between opposed die surfaces and providing movable plate within the die cavity and a ring on the opposed surface of the first die that engages the flange and the part in the cavity in a uniform manner. The movable plate and ring are then translated away from the die surfaces to uniformly move the part from the first die after the dies are separated.

2 Claims, 2 Drawing Sheets

EJECTION OF SUPERPLASTICALLY FORMED PART WITH MINIMUM DISTORTION

BACKGROUND OF THE INVENTION

The present invention relates to the superplastic forming of metal parts, and particularly to a method of removing the same from a die cavity in which the parts are superplastically formed.

U.S. Pat. Nos. 4,381,657 and 4,502,309 to Hamilton et al discuss the problems attendant with removing superplastically formed parts from die cavities. As discussed, the problem lies in the fact that ductile metals are formed at high temperatures and thus under low stress conditions, and are removed while they are still at a substantially high temperature. Because of this, the parts are still relatively soft and thus have a low strength characteristic such that they are easily deformed in the process of being removed. If the part is allowed to cool, the die will also cool making production rates exceedingly low as well as requiring substantial energy to reheat the die. In addition, differential shrinkage between the part and the die can lead to part deformation as well as locking of the part in the die, particularly with dies having near zero draft angles for the die cavity.

In addition, because of the high temperatures at which superplasticity is effected, lubricants are ordinarily not effective; many lubricants evaporate or combust at such temperatures. Hence, when the part is formed between the dies, there is intimate metal-to-metal contact.

Boron nitride is a commonly used lubricant/separating agent. It, however, does not prevent sticking and presents other problems discussed below.

Both of the above patents disclose a vacuum method of removing a superplastically formed part from a die cavity. More particularly, a vacuum is formed between an upper die and the formed part in a cavity of the lower die. The vacuum secures the part to the face of the upper die. The dies are then separated, the upper die pulling the part from the cavity of the lower die.

In pulling a part from a die cavity there remains the possibility of deforming and stretching the part if the part in the cavity tends to stick to the surfaces of the cavity. In addition, when a vacuum is employed it is often pulled through small openings in a die structure, which can be plugged by scale and any lubricant that may be used. The above-mentioned boron nitride, for example, is a slurry formulation; the liquid portion thereof evaporates at the elevated temperatures employed for superplastic forming leaving a powder residue on the surfaces of the dies.

BRIEF DESCRIPTION OF THE INVENTION

The present invention is directed to a purely mechanical means for removing a superplastically formed part from the cavity of a female die. The mechanical means includes a movable ring located on a peripheral surface extending about the cavity, and a movable plate or ring member (depending on the internal configuration of the female die) located in the cavity, the two members engaging respectively the entire flange and bottom wall portion of the part after it is formed. The part is easily removed from the die and cavity by simple simultaneous translation of the movable ring and plate in a direction away from the peripheral and cavity surfaces, which translates simultaneously the flange and main body of the part. In this manner there is no tendency to deform the flange or stretch the sidewall of the part, as the flange and main body are moved together.

After the part is moved away from the die surfaces, the ring can be lowered to leave the part accessible for automatic or manual unloading from the extended plate.

Applicants' mechanical means, which can be operated by hydraulic or air cylinders, eliminates any problem of clogging of vacuum ports.

THE DRAWINGS

The invention, along with its objectives and advantages, will be best understood from the following detailed description and the accompanying drawings in which.

PREFERRED EMBODIMENT

Figure 1:
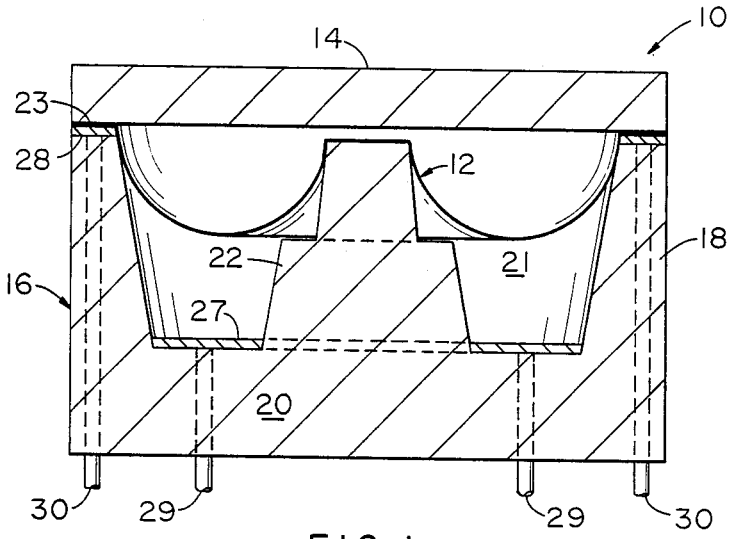
FIGS. 1 and 2 are schematic representations in vertical section of two (upper and lower) dies disposed in the process of forming a part.
Figure 2:
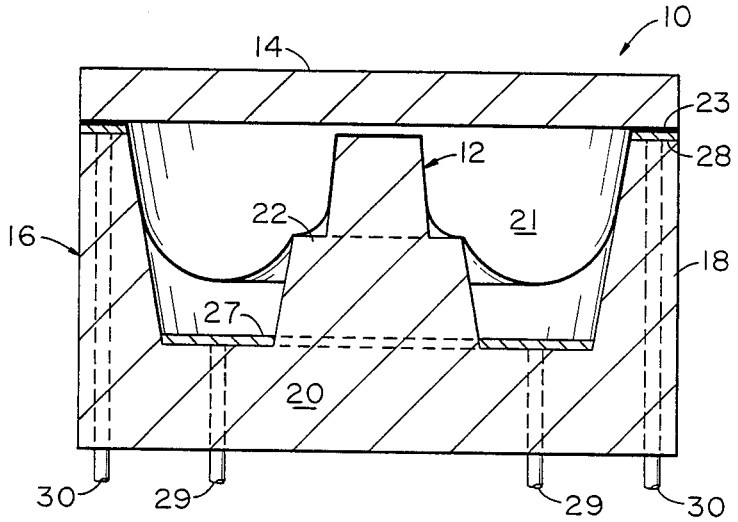
Figure 3:
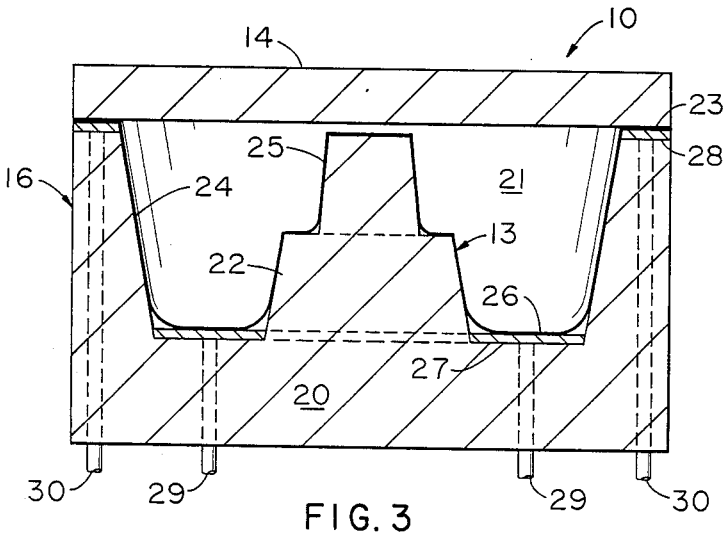
FIG. 3 shows the part of FIGS. 1 and 2 completed in the lower die.

Referring now to FIGS. 1 and 2 of the drawings, a die apparatus 10 is diagrammatically represented and shown vertically disposed about a metal blank 12 in a process of being superplastically formed between upper and lower dies 14 and 16 of apparatus 10. The blank starts out as a flat sheet disposed between the lower and upper dies. The vertical disposition of the die components in the figures is illustrative only, as dies 14 and 16 can be horizontally disposed and operated, for example.

Lower die 16 is a female structure having an inner configuration and surfaces that shapes blank 12 into a completed part 13. Hence, as depicted in the drawings, die 16 has side walls 18 and an inner or lower wall 20 providing a cavity 21. For purposes of illustration, the female die is shown provided with a somewhat complex cone 22 integral with the lower wall of the die and centrally located in the cavity of the die. Hence, cavity 21 has an annular configuration in plan view.

Part 13 is superplastically formed from the blank of material 12 in cavity 21 in the basic manner discussed earlier, i.e., ductile sheet materials are formed in female die 16 under the force of pressurized fluid at high temperatures such that the material of 12 exhibits low stress in the process of being stretched to form complex shapes.

In the forming process, the periphery (23) of blank 12 is secured between opposed peripheral surfaces of the upper and lower dies such that, as the blank is being formed into part 13, a peripheral flange (23) of the part is provided between the opposed die surfaces. The part is thus formed with an outer side wall 24 and opposed side walls 25 in the annular cavity of the female die, with wall 25 taking the shape of die cone 22. In addition, a lower inner wall 26 of part 13 is formed on the inner surface of die wall 20. Wall 26 is also annular, as it is formed in annular die cavity 21.

At the high temperatures employed in superplastic forming, the surfaces of the part adhere to the surfaces of the dies. Any lubricants that might be employed evaporate or oxidize at such temperatures so that they are relatively ineffective in separating the part from the female die.

When the dies are separated, the adherence of part 13 to the extended surfaces of cavity 21, as opposed to the limited area at which the other die 14 contacts flange 23, the limited surface of die 14 separates from the flange, leaving part 13 secured in the female die, i.e., stuck to the upper and inner surfaces of walls 18 and 20 and cone 22.

Removal of the part from the female die is difficult, as explained earlier. A lever, i.e., a crowbar, inserted under flange 23, is a common method of removing the part though, as discussed above, vacuum removal methods are disclosed in the two U.S. patents noted above. The crowbar method can deform the part to the point that the part is rendered useless for its intended purpose. And, if the dies and part are allowed to cool, such that the part attains a certain strength, reheating the die requires time and energy, such that the forming and removal process becomes slow and costly.

The present invention solves the problem by use of a movable annular or plate structure 27 located in or on the inner surface of wall 20 of female die 16, and around cone 22. A movable flat ring 28 is also shown provided and mounted on the upper or peripheral face or surface of side wall 18 of die 16.

The configurations (planar) of 27 and 28 match those of annular wall 26 and flange 23 which, in the figures of the drawing, are generally planar. If the configuration of part 12 was other than that depicted, the shape of 27 and 28 would obviously match the shape of 23 and 26. In this manner, the annular plate and ring structures uniformly engage the areas of wall 26 and flange 23.

Figure 4:
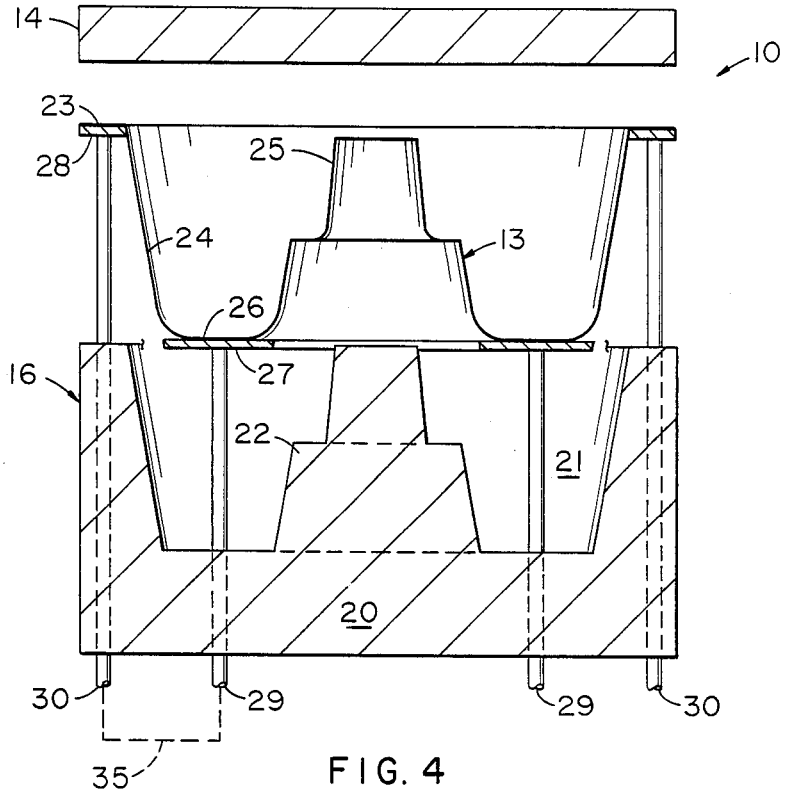
FIG. 4 shows the dies of the figures separated, with the part removed from the lower die in accordance with the principles of the present invention.
Figure 5:
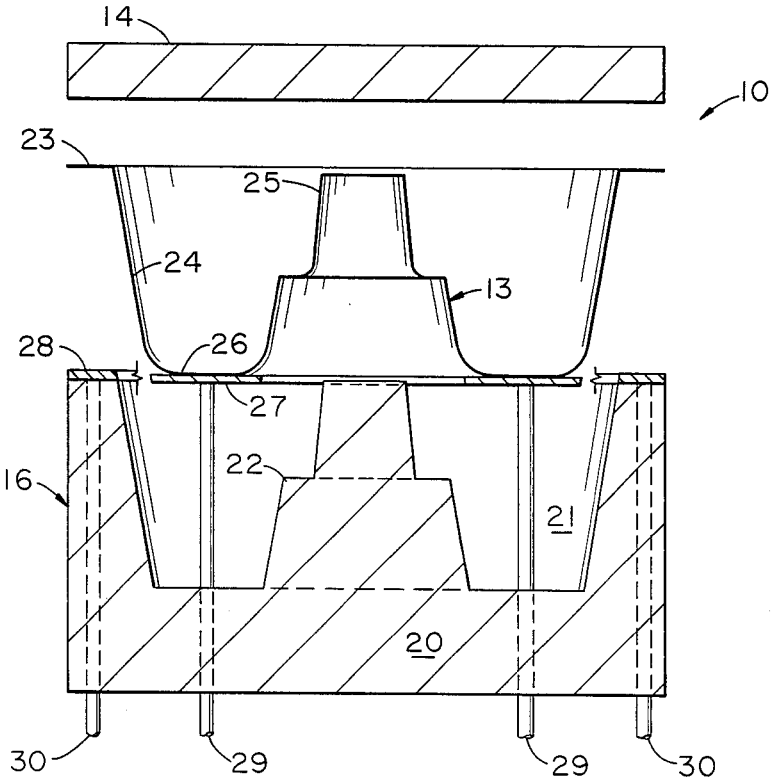
FIG. 5 shows the dies of FIG. 4 still separated, but with a peripheral ring returned to the periphery of the lower die.

The movable plate 27 and ring 28 are shown mounted on and secured to shafts 29 and 30, respectively, which shafts are shown located in respective openings (not shown) provided in wall structures 18 and 20. Such shafts can be translated by suitable, fluid actuated cylinders, for example, or by other mechanical means (not shown). What is important is that the shafts be actuated (moved) together, as indicated schematically by dash line 35 in FIG. 4, such that ring 28 and plate structure 27 are moved away (upwardly) from the surfaces of die walls 18 and 20 at the same time. In this manner, flange 23 of part 13 and the main body of the part, i.e., side and inner walls of the part, are moved simultaneously so that the integrity of the part, which is heated and relatively soft, is maintained in the process of being separated (unstuck) from the surfaces of die 16.

It can be appreciated that a soft, low strength part superplastically formed in the manner described is readily separated from a heated female die in the manner described.

While the invention has been described in terms of preferred embodiments, the claims appended hereto are intended to encompass all embodiments which fall within the spirit of the invention.

What is claimed is:

1. A method of removing a part from a first die after the part has been superplastically formed in the die at an elevated temperature from a blank of material, the part tending to adhere to the surfaces of the die and having relatively low strength because of the elevated temperature at which the part is formed such that the removal of the part from the die without deforming the part while it has such low strength is difficult, the method comprising the steps of:

providing opposed dies and peripheral die surfaces for clamping a peripheral portion of a blank therebetween, which portion forms an integral flange of the part when the part is superplastically formed, providing movable means within a cavity of the first die that occupies one or more relatively broad surface areas of the cavity such that the movable means is positioned to uniformly engage relatively broad areas of the part superplastically formed in association with the broad surface areas of said cavity, providing movable means on the peripheral surface of the first die that generally matches and uniformly engages the area of the flange of the part, separating the dies, moving the means that uniformly engage the cavity and flange portions of the part simultaneously in a direction away from the die surfaces to remove the part from the die cavity and periphery while it has low strength without deforming the part, and retracting the movable means on the periphery of the first die toward the first die such that the part remains exposed on the means movable from the cavity of the first die, thereby providing access for removal of the part from said last named movable means.

2. Apparatus for removing a relatively soft part from a die after it has been superplastically formed in the die without distorting the part, the apparatus including:

opposed, first and second dies and peripheral die surfaces for clamping a peripheral portion of a blank therebetween, which peripheral portion will form an integral flange of the part when it is superplastically formed in a cavity of one of the dies, movable means for uniformly engaging wall portions of the part in the cavity of the one die, said means having a configuration that generally matches relatively broad areas of the part after it is formed in the cavity, movable means for uniformly engaging the flange of the part located on the periphery of the one die, said last named movable means having a shape that matches that of the flange, means for simultaneously translating the movable means for simultaneous movement of the wall portions and flange of the part from the cavity and periphery of the one die after the first and second dies are separated and while the part is relatively soft, and means for retracting the movable means located on the die periphery toward the die periphery, thereby leaving the part exposed on the means movable from the die cavity so that the part is accessible for removing from said means movable from the cavity.

* * * * *